US012486727B1

(12) United States Patent
Jamison et al.

(10) Patent No.: US 12,486,727 B1
(45) Date of Patent: Dec. 2, 2025

(54) DRILLING EVENT DETECTION

(71) Applicant: Halliburton Energy Services, Inc., Houston, TX (US)

(72) Inventors: Dale E. Jamison, Houston, TX (US); Andrew Vos, Houston, TX (US); Mateusz Michal Dyngosz, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/731,653

(22) Filed: Jun. 3, 2024

(51) Int. Cl.
*E21B 21/06* (2006.01)
*E21B 21/08* (2006.01)

(52) U.S. Cl.
CPC ..... *E21B 21/08* (2013.01); *E21B 21/065* (2013.01)

(58) Field of Classification Search
CPC ..... E21B 21/065; E21B 21/08
See application file for complete search history.

(56) References Cited

U.S. PATENT DOCUMENTS

| | | | |
|---|---|---|---|
| 6,234,250 | B1 | 5/2001 | Green et al. |
| 8,812,236 | B1 | 8/2014 | Freeman et al. |
| 9,000,358 | B2 | 4/2015 | Jamison et al. |
| 10,309,173 | B2 | 6/2019 | Kleinguetl et al. |
| 10,435,967 | B2 | 10/2019 | Kleinguetl et al. |
| 10,539,002 | B2 | 1/2020 | Ye |
| 10,564,083 | B2 | 2/2020 | Spoerker |
| 10,612,374 | B2 | 4/2020 | Kleinguetl et al. |
| 10,697,876 | B1 | 6/2020 | Jamison et al. |
| 10,988,996 | B2 | 4/2021 | Ye et al. |
| 10,989,046 | B2 | 4/2021 | Al-Rubaii et al. |
| 11,085,285 | B1 * | 8/2021 | Ye ..... E21B 44/06 |
| 11,091,989 | B1 | 8/2021 | De Oliveira et al. |
| 11,143,540 | B2 | 10/2021 | Jamison et al. |
| 11,243,155 | B2 | 2/2022 | Shojaei et al. |
| 11,255,180 | B2 | 2/2022 | Zhang et al. |
| 11,473,426 | B2 * | 10/2022 | Jamison ..... B81B 3/0045 |

(Continued)

FOREIGN PATENT DOCUMENTS

WO 2013032445 A1 3/2013

OTHER PUBLICATIONS

Halliburton. "BaraLogix® real-time service." Halliburton Company Website, https://www.halliburton.com/en/products/baralogix. Accessed Aug. 6, 2024.
Halliburton. BaraLogix® Services Enable Operator to Maintain Stable Wellbore in HPHT Conditions. Halliburton, 2017. H012442 1/17. PDF file. 2 pages.
Halliburton. Integrated Approach to Fluid Performance Reduces Days on Well by 30 Percent. Halliburton, 2019. H013332 07/19. PDF file. 2 pages.

(Continued)

*Primary Examiner* — Matthew R Buck
(74) *Attorney, Agent, or Firm* — Michael Jenney; C. Tumey Law Group PLLC

(57) ABSTRACT

A variety of methods and apparatus are disclosed, including, in one embodiment, detecting a drilling event, involving flowing a drilling fluid from a wellbore being drilled through a separator, removing rock cuttings from the drilling fluid by the separator, discharging the drilling fluid from the separator without the rock cuttings removed to a mud pit, measuring a first viscosity of the drilling fluid upstream of the mud pit with a single point viscometer, measuring a second viscosity of the drilling fluid in the mud pit or downstream of the mud pit with a second viscometer that is not a single point viscometer, and detecting a drilling event associated with drilling of the wellbore by comparing the first viscosity with the second viscosity.

20 Claims, 3 Drawing Sheets

(56) References Cited

U.S. PATENT DOCUMENTS

| | | | | |
|---|---|---|---|---|
| 11,493,463 | B2 | 11/2022 | Ye et al. | |
| 11,536,132 | B2 | 12/2022 | Xia et al. | |
| 11,713,652 | B1 | 8/2023 | Jamison et al. | |
| 11,815,639 | B2 | 11/2023 | Ye et al. | |
| 2007/0215346 | A1 | 9/2007 | Sloan et al. | |
| 2013/0113491 | A1 | 5/2013 | Rodney | |
| 2013/0192360 | A1 | 8/2013 | Jamison et al. | |
| 2014/0166361 | A1* | 6/2014 | Jamison | E21B 44/00 175/24 |
| 2014/0166871 | A1 | 6/2014 | Jamison et al. | |
| 2016/0341646 | A1 | 11/2016 | Jamison | |
| 2017/0176310 | A1 | 6/2017 | Jamison et al. | |
| 2017/0198536 | A1* | 7/2017 | Song | E21B 41/00 |
| 2018/0202246 | A1* | 7/2018 | Kleinguetl | E21B 21/06 |
| 2019/0055799 | A1* | 2/2019 | Aguirre | G06Q 10/0639 |
| 2019/0360286 | A1 | 11/2019 | Ye et al. | |
| 2020/0064245 | A1 | 2/2020 | Gajji et al. | |
| 2021/0010878 | A1 | 1/2021 | Jamison et al. | |
| 2021/0025840 | A1 | 1/2021 | Ye et al. | |
| 2021/0048425 | A1 | 2/2021 | Ye et al. | |
| 2021/0063294 | A1 | 3/2021 | Ye et al. | |
| 2021/0238938 | A1 | 8/2021 | Jamison et al. | |
| 2021/0324734 | A1 | 10/2021 | Jamison et al. | |
| 2022/0186617 | A1 | 6/2022 | Ye et al. | |
| 2023/0175393 | A1 | 6/2023 | Kulkarni et al. | |
| 2023/0220760 | A1 | 7/2023 | Benson et al. | |
| 2024/0151132 | A1 | 5/2024 | Jamison et al. | |

OTHER PUBLICATIONS

Okeke-Agulu, Ejikeme. "Halliburton's BaraLogix™ Bags OTC 2016 Spotlight on New Technology Award." LinkedIn Pulse Publishing Platform, May 2016, pp. 1-5. PDF file. 5 pages.

Bell, Jason. American Association of Drilling Engineers—BaraLogix® Equipment & Services. Halliburton, 2018. 2018 Tech MKT. PDF file. 6 pages.

Offshore Magazine Staff. "OTC 2016: Halliburton develops density and rheology unit." Offshore Digital Magazine, Apr. 2016, pp. 1-3. PDF file. 3 pages.

Galliano, Clint et al. "Automating drilling fluid analysis." Offshore Engineer Digital Magazine, Apr. 2016, pp. 1-4. PDF file. 4 pages.

Fann. "Model 35 Rotational Viscometer." Fann Instrument Company Website, https://www.fann.com/en/products/model-35. Accessed Aug. 6, 2024.

Fann. Model 35A/SR12 Viscometer Product Information Data Sheet. Fann Instrument Company, 2007. PDF file. 2 pages.

Rheonics. "SRD Inline process density meter and viscometer." Rheonics Company Website, https://rheonics.com/products/inline-density-meter-srd/. Accessed Aug. 6, 2024.

Rheonics. SRD Inline Process Density Meter and Viscometer Data Sheet. Rheonics GmbH, SRD-DS-2212. PDF file. 6 pages.

International Search Report and Written Opinion for International Patent Application No. PCT/US2025/021447 dated Jul. 10, 2025. PDF file. 10 pages.

* cited by examiner

DRILLING EVENT DETECTION

BACKGROUND

A borehole (wellbore) may be drilled into a subterranean formation for the exploration or extraction of crude oil, natural gas, water, brine, or metallic ore, or other natural resources. A drill site may be a location for natural-resource exploration and production activities. The drill site may be on-shore or an off-shore platform. The borehole may be formed (drilled) through the Earth surface into the subterranean formation. The drill site may be a workplace and have equipment to drill a well (e.g., oil and/or gas well) and establish associated infrastructure such as a wellhead platform. The drill site may include a mounted drilling rig that is a machine that creates holes in the Earth subsurface. The term "rig" may refer to equipment employed to penetrate the surface of the Earth into the Earth crust. Oil and natural-gas drilling rigs create holes to identify geologic reservoirs and for the extraction of oil or natural gas from reservoirs.

To form a hole in the ground, a drill string having a drill bit may be lowered into the hole being drilled. In operation, the drill bit may rotate to break the rock formations to form the hole as the borehole. In the rotation, the drill bit may interface with the ground or formation to grind, cut, scrape, shear, crush, or fracture tock to drill the hole. In operation, a drilling fluid (also known as drilling mud) is circulated down the drill string through nozzles of the drill bit to the bottom of the borehole. The drilling fluid may then flow upward to the surface through an annulus formed between the drill string and the wall of the borehole. The drilling fluid may cool the drill bit, apply hydrostatic pressure upon the formation penetrated by the borehole, and carry formation (rock) cuttings to the surface, and so forth.

The drilling site may include surface equipment such as tanks, pits, pumps, and piping for circulating drilling fluid (mud) through the borehole. Settling equipment or a separation vessel, such as a shale shaker, may receive a slurry of the drilling fluid and rock cuttings (drill cuttings) from the borehole. The shale shaker may separate rock cuttings from the drilling fluid. Pits may collect the rock cuttings. In some cases, a mobile laboratory onsite may test the drilling fluid or rock cuttings. Temporary housing may be provided at the drill site for operating personnel, and the like. During production after drilling, the site may include storage vessels and access to a pipeline for transport of crude oil and natural gas to processing facilities.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
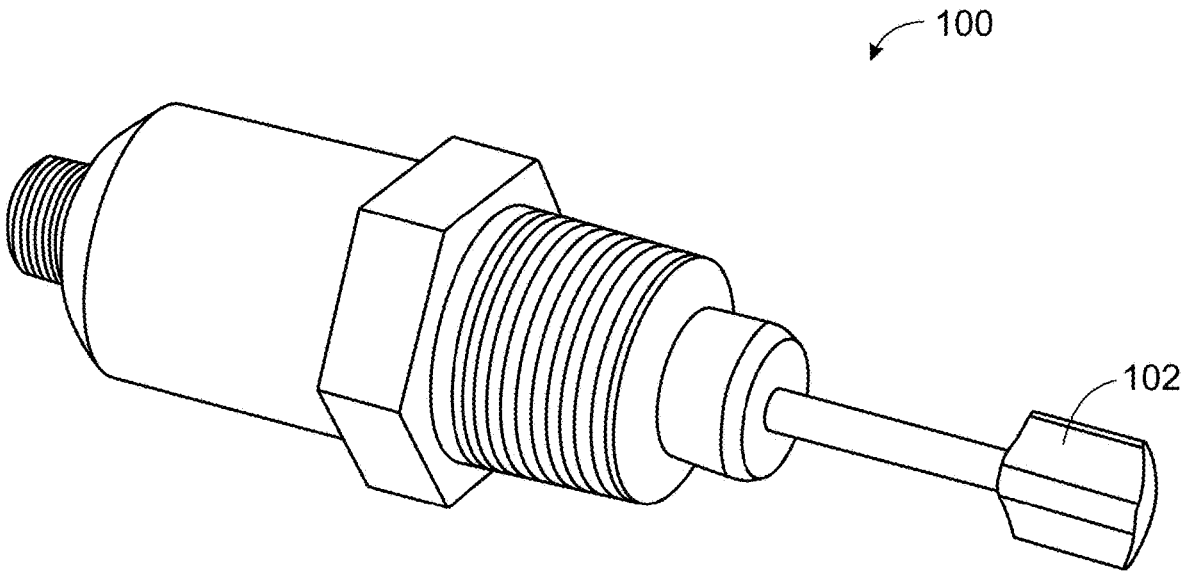
FIG. 1 is a diagram of a single-point viscometer.

Some aspects of the present disclosure are directed to drilling event detection utilizing a single point viscometer during drilling of a borehole. In implementations to detect a drilling event during the drilling, the single point viscometer may be utilized in conjunction with a viscometer that is not a single point viscometer.

The drilling event detection may be a real-time drilling event detection. The drilling event detection may be based on real time data (or near real time data). The drilling event detection may be before (in anticipation of) and/or during occurrence of the drilling event.

The detection of events that can impact drilling outcomes can be beneficial for real-time drilling improvement or optimization. Some drilling events (e.g., adverse drilling events) may slow drilling, resulting in increased drilling cost. Some drilling events can be catastrophic to the point of well loss (e.g., complete well loss). Regardless of the severity or nature of the event, it may be desirable to determine if and when an event occurs and to have actionable remedies in place.

In implementations to indicate viscosity of a fluid, a single point viscometer can generally employ a technique of (1) applying shear to the fluid in which the shear rate is not well defined or varies with time and (2) measuring an averaged physical response from the fluid. The physical response may be, for example, shear stress (e.g., in units of centipoise). The measured values of the averaged physical response change as the viscosity of the fluid changes. Thus, the single point viscometer can distinguish thicker (more viscous) fluids from thinner (less viscous) fluids. Yet, the actual or true viscosity of the fluid is not directly measured with a single point viscometer, but instead a viscous response (e.g., the aforementioned averaged physical response) is measured in which the viscous response is caused by some averaged and/or unknown true shear rate (dV/dy) [derivative of the velocity (V) with respect to distance (y)]. Thus, in implementations of measurements with a single point viscometer, such as the Rheonics, Inc. (Rheonics) viscometers discussed below, the shear rate is generally not known. The single-point viscometer (e.g., Rheonics) style measurements work well for Newtonian fluids (because the viscosity does not change with shear rate) but also work with non-Newtonian fluids, such as drilling fluids.

In implementations, a viscometer that is not a single point viscometer can be utilized to measure viscosity of the fluid contemporaneous with the single-point viscometer measurements. Thus, this second viscometer can perform as a calibration check of the single point viscometer, including in real time. A comparison of measurements of both viscometers can better define the results of the single point viscometer. The second viscometer (not a single point viscometer) can be labeled as a calibrating viscometer in the sense that viscosity measurements by the second viscometer can be utilized to calibrate the first viscometer (the single point viscometer). The second viscometer can be a typical oilfield viscometer (e.g., a direct-indicating viscometer such as a Fann 35 viscometer or similar) or a viscometer of a density and rheology unit (DRU), as discussed below, and the like.

Again, to detect a drilling event, a single-point viscosity measuring device (e.g., single point viscometer) may be utilized in conjunction with a viscometer that is not a single point viscometer to measure and infer viscosity of the circulating drilling fluid in real time. The single point viscosity measurement can be calibrated based on the response of a typical oilfield rheometer (e.g., Fann 35, DRU real time unit, etc.) that is a second viscometer not a single point viscometer. The oilfield rheometer (including viscometer) may provide for a calibration technique of the single point device, thus in combination can provide effective measurements of the non-Newtonian character of servicing fluids. In implementations, the single-point viscosity measuring device and/or the typical oilfield viscometer device may incorporate a density measuring device (density meter, densimeter, densitometer) to measure density or specific gravity of the circulating drilling fluid. Therefore, the viscosity measuring device (e.g., viscometer) can be a viscosity and density measuring device.

As indicated for certain implementations, the second viscometer (e.g., for checking or calibration of the single point viscometer) may be a direct-indicating viscometer such as a Fann viscometer. The Fann viscometer may be, for example, a Fann Model 35 viscometer (Fann 35 viscometer) available from Fann Instrument Company having headquarters in Houston, Texas, USA. A Fann 35 viscometer is a Couette style viscometer that uses various defined shear rates to facilitate measurement of a shear stress at those respective shear rates. This shear stress versus shear rate data is used to define constants of a rheological model. In oil field applications, a Herschel-Bulkley model is commonly employed. The Bingham and Power Law models have been used and, in some cases, are still employed, but generally have been proven to be less accurate for modeling most fluids employed in drilling operations. This direct-indicating viscometer (Fann 35 viscometer) is a prevalent rheometer (including viscometer) in drilling operations worldwide including the drilling rig. These are typically manual devices in which fluids engineer collect a sample of fluid (drilling fluid) from the mud pits and go to a different location and perform a mud (drilling fluid) check with the direct-indicating viscometer (Fann 35 viscometer). The frequency of such manual sampling and checking the viscosity of the drilling fluid may be, for example, 4 times per day. A problem with this alone (without being utilized in conjunction with a single point viscometer) is the measurement can be too intermittent with significant time intervals. The drilling fluid viscosity can change between measurements. Thus, drilling events may go undetected for extended periods. Hence, there is benefit of continuous real time measurements (or substantially continuous and near real time) provided by the inline single-point viscometer with calibration adjustments given by a typical oilfield rheometer.

The single-point viscosity measuring device (e.g., single point viscometer) can be an inline viscometer. An inline viscometer may be termed as inline because the measuring section of the viscometer may be disposed in a conduit or pipe in which the fluid being measured flows, or placed in the pipe wall. In implementations, the inline single-point viscometer is configured for the drilling fluid to flow continuously through the measurement portion of the viscometer. Such may facilitate use of the inline single-point viscometer in circulating drilling fluid having rock cuttings, including relatively large rock cuttings. As indicated, the inline single-point viscometer can be an inline device additionally configured to measure density (specific gravity) and thus be labeled as an inline single-point viscosity and density measuring device. Examples of applicable single-point viscosity measuring devices (with or without capability to measure density) include Rheonics single point viscometers (e.g., the Rheonics viscometer depicted in FIG. 1 that measures both viscosity and density) available from Rheonics, Inc. having headquarters in Sugar Land, Texas, USA.

An information system may receive data from the both the single point viscometer and the second viscometer (not a single point viscometer), perform calculations related to detecting a drilling event, and present results. The technique including evaluation may help to determine when an event occurs (including when the event begins) and the rate or timing at which that event unfolds. The second viscosity measuring device (not a single point device) and an associated information system can be, for example, the Baralogix® system available from Halliburton Company having headquarters in Houston, Texas, USA. In such a case, the second viscosity measuring device may be a Baralogix® DRU (or component of the DRU).

FIG. 1 is an example of an inline single-point viscometer 100. In this illustrated example, the viscometer 100 includes a sensing element 102 that interfaces with the flowing drilling fluid for measuring viscosity and density of the drilling fluid. In this example, the sensing element 102 is paddle-like in configuration and oscillates with a frequency response due to the viscosity and density of the flowing drilling fluid. Thus, the measurement interface with the drilling fluid is on the exterior (exterior surface) of the sensing element 102. The particular inline single-point viscometer 100 depicted is the Rheonics SRD by Rheonics, Inc. that is an inline viscometer and density meter. The Rheonics SRD has a compact form-factor and measures viscosity of Newtonian and non-Newtonian fluids. As an example, the Rheonics SRD is an all-metal construction that is stainless steel 316L, and operational to 500 bar absolute and 300° C. An applicable Rheonics inline viscometer analogous to the Rheonics SRD but without a density meter is the Rheonics SRV inline viscometer.

The single point viscometer (e.g., a Rheonics viscometer such as the Rheonics SRD and which can be labeled as a Rheonics sensor) provides real time viscosity data that can be used in conjunction with real time drilling operations and data (e.g., Baralogix® data) from the second viscometer (e.g., DRU or multipoint viscometer) and from the information system to advance drilling event detection. The single point viscometer (e.g., a Rheonics inline single-point viscometer and density meter) can provide for a viscosity indicator and pressurized density values as the drilling fluid leaves the well. This may provide an improved drilling event detection (and early warning) system. Such may facilitate automation of the rig site, providing insight into events happening in real time and thus allowing better drilling automation in implementations. Employment of the single point viscometer in conjunction with a Baralogix® system or similar system may promote better real time analysis of potential drilling events and their outcomes. Though a Rheonics single-point viscometer may be beneficial, other single-point viscometers may be employed. Other single point (e.g., Newtonian fluid assumption) vibrating and Poiseuille flow techniques may be utilized.

Figure 2:
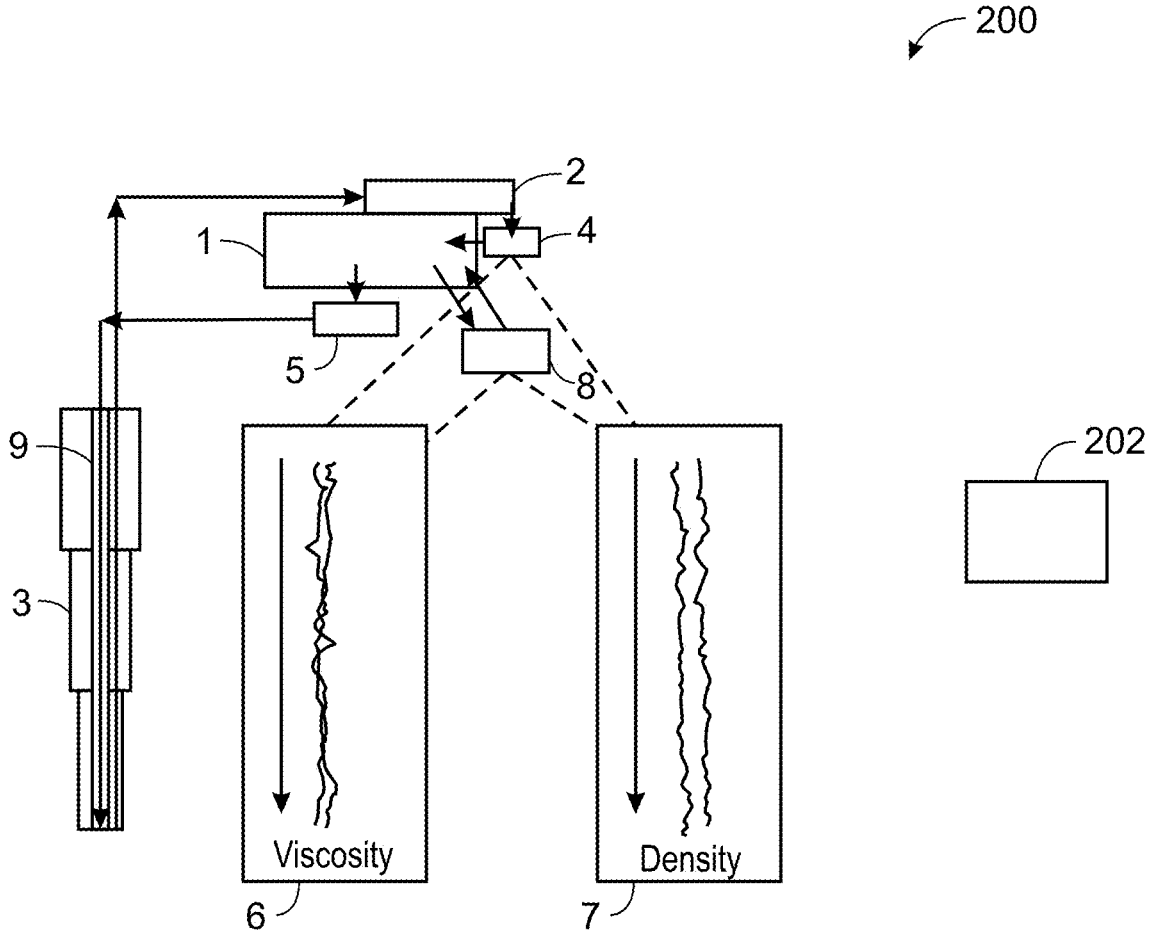
FIG. 2 is a diagram of a drilling system.

FIG. 2 is a drilling system 200 that employs a mud pit 1 and a separator 2 (e.g., shaker) in the drilling of a wellbore 3 having a drill pipe 9. In operation, the separator 2 removes rock cuttings from the circulating drilling fluid and discharges the drilling fluid without the removed rock cuttings into the mud pit 1. The mud pump 5 receives drilling fluid from the mud pit 1 and discharges the drilling fluid through the drill string 9 in the wellbore 3. In implementations, the separator 2 is or includes a shaker, such as shale shaker that may be a vibrating sieve. Shell shakers are utilized to remove large solids or cuttings (e.g., drilled solids) from the drilling fluid (mud). The shale shaker may separate cuttings from the drilling fluid by routing the drilling fluid through a vibrating screen.

The circulating drilling fluid flowing from the mud pit 1 (via the mud pump 5) into the wellbore 3 can be labeled as drilling fluid supply (to the wellbore 3). The circulating drilling fluid flowing from the wellbore 3 to the separator 2 can be labeled as drilling fluid return (from the wellbore 3). A change in the viscosity (and/or density) of the drilling fluid return compared to the viscosity (and/or density) of the drilling fluid supply can be caused by operating conditions downhole in the wellbore 3 and be an indication of a drilling event.

To determine viscosity of the circulating drilling fluid, the drilling system 200 includes a single point viscometer 4 and a second viscometer 8 that is not a single point viscometer. In implementations, the single point viscometer 4 can be an inline single-point viscometer 4 (e.g., see FIG. 1). In the illustrated embodiment, the single point viscometer 4 measures properties of the drilling fluid returning from the wellbore 3. The second viscometer 8 is utilized to measure properties of the drilling fluid in the mud pit 1, which is drilling fluid being supplied to the wellbore 3. The properties can include viscosity, density, and other properties of the drilling fluid. The property values as measured by the single point viscometer 4 can be different than the respective property values as measured by the second viscometer 8. Such may indicate a drilling event or a calibration issue of the single point viscometer 4.

The second viscometer 8 (defined herein as not a single point viscometer) can be an online device (e.g., online viscometer) that continuously or intermittently measures properties (e.g., viscosity, density, etc.) of the drilling fluid. The second viscometer 8 can instead be, for example, a handheld device or a laboratory instrument. For the second viscometer 8 as a laboratory instrument and in some implementations of the second viscometer as a handheld device, a sample of the drilling fluid may be manually collected (e.g., by a human operator) for analysis by the second viscometer 8.

In embodiments, the measured property data from the second viscometer 8 may be continuously (or substantially continuously) collected, and that provides for property values (e.g., viscosity, density, etc.) for the drilling fluid going into the wellbore 3. For these continuous or substantially continuous measurements, the second viscometer 8 can be, for example a multipoint system (multipoint viscometer, multipoint rheometer, etc.), such as a Baralogix® DRU or component(s) of the Baralogix® DRU. In embodiments, the second viscometer 8 (e.g., as a direct-indicating viscometer, such as a Fann 35 viscometer) is utilized to periodically (not continuously) measures properties of the drilling fluid and including in examples with manual sampling, as discussed.

As indicated, the drilling system 200 includes the single point viscometer 4 to measure viscosity of drilling fluid circulated by the mud pump 5. The single point viscometer 4 may include a density meter to measure density (or specific gravity) of the drilling fluid. The single point viscometer 4 may be situated, for example, [A] after the separator 2 (e.g., shaker), such as in a conduit between the separator 2 and the mud pit, or [B] in a conduit (flow line) conveying drilling fluid into the separator 2. Placement of the single point viscometer 4 in a flow line may utilize flow paths and valving not shown in FIG. 2. In operation, the single point viscometer 4 may provide viscosity data 6 and density data 7 of the drilling fluid. The data 6, 7 may be real time data (or near real time).

As mentioned, the drilling system 200 includes the second viscometer 8 utilized to measure viscosity of the drilling fluid at or in the mud pit 1. The second viscometer 8 may instead be utilized (not shown) to measure viscosity of the circulating drilling fluid after the mud pump 5. In particular, the second viscometer 8 may be utilized, for example, to measure properties (e.g., viscosity and density) of the drilling fluid circulating at surface between the mud pump 5 and the wellbore 3. Again, the second viscometer 8 (which may be a system) may include a density meter to measure density (or specific gravity) of the drilling fluid. The second viscometer 8 may provide viscosity data 6 and density data 7 of the drilling fluid.

An aspect is the continuous (or substantially continuous) comparison of real time data 6, 7 from the second viscometer 8 of drilling fluid in the mud pit 1 to the real time data 6, 7 from the single point viscometer 4 of the drilling fluid after the separator 2. The properties as measured by the single point viscometer 4 are an indication of the drilling fluid as supplied to the wellbore 3. The properties as measured by the second viscometer 8 are an indication of the drilling fluid as returned from the wellbore 3. The returning drilling fluid (from the wellbore 3) may have measurable differences in viscosity (and density) than that of the drilling fluid that enters the wellbore 3, which can be a result of a drilling event. Such a drilling event can be, or example, water influx, gas influx, solids increase due to torn shaker screen, reactive shales not being sufficiently treated with mud additives, salt stringer, tar stringer, and drill solids build up (over longer periods of time). These events and other drilling events may be detected by viscosity and/or density measurements of the drilling fluid. To distinguish between a calibration issue (of the single point viscometer 4) versus an impending or occurring drilling event, operating parameters (other than drilling fluid viscosity and density) of the drilling can be considered (evaluated).

As noted for implementations, the second viscometer 8 may be, for example, a DRU of a Baralogix® system. A Baralogix® DRU may generally be a single, modular device that allows real-time measurements of fluid density and rheology (including viscosity). Thus, an aspect may be the continuous (or substantially continuous) comparison of real time Baralogix® DRU rheological and density data of the drilling fluid in the mud pit 1 to the single point viscosity and density measurements of the drilling fluid by the single point viscometer 4 after the separator 2 (e.g., shaker). Rheology data measured and collected may include shear rate, shear stress, viscosity, 10 second gels, 10-minute gels, and 30-minute gels, etc.

The drilling system 200 may include an information system 202 that analyzes (evaluates) the data 6, 7 and outputs (presents) drilling event detection. The information system 202 may consider drilling operation data generally. See, for instance, the Examples as including output generally from the information system 202 regarding drilling event detection. The evaluation by the information system 202 may typically involve calculations. The information system 202 may have a processor (hardware processor) and memory (e.g., solid state memory, etc.) storing code (logic, instructions) executable by the processor to perform the analysis (evaluation) and perform calculations. Such may incorporate machine learning including artificial intelligence (AI), a neural network, linear regression, feed forward, and so forth. In implementations, the information system 202 may be associated with Baralogix® drilling fluid graphics (DFG). Baralogix® real-time service (RTS) may combine DFG, hydraulic software, surface measurement automation, and predictive analytics.

Some drilling events that a single-point viscometer (and density meter), such as a Rheonics viscometer or sensor, may help to detect in a real time application include gas or liquid influx, drill solids build up in the fluid system, over treatment of the drilling fluid with some additives or treatment components (e.g., water, oil, viscosifiers, weighting materials, and thinners), under treatment of drilling fluid with some additives or treatment components (e.g., emulsifiers, lost circulation materials, clay inhibitors, and weighting material), bit wear, caving event, stuck pipe, and poor hole cleaning. Typical real time input data that may be utilized in the evaluation and prediction include rate of penetration (ROP), stand pipe pressure (SPP), flow rate of drilling fluid, torque of the drill bit, drag, multipoint viscosity (e.g., DRU rheology) multipoint density (e.g., DRU viscosity), multipoint density (e.g., DRU density), single-point viscosity (e.g., Rheonics viscometer measurement of viscosity), single-point density (Rheonics viscometer/density meter measurement of density), Rheonics versus DRU delta viscosity, Rheonics vs DRU delta density, mud pit level (liquid level), pressure while drilling (PWD) versus modeled ECD, and cuttings transport efficiency. This data, when combined with machine learning (e.g., AI, etc.) and/or other analytical techniques, may be utilized to detect the onset of various events. Examples of the anticipated trends of these data that may indicate a particular event are given in the Examples below. Patterns of these trends may be detected. Additionally, the well geometry may be utilized to help characterize the well type and drilling characteristics. Properties, such as well geometry (hole size and hardware, etc.), measured depth, geothermal profile, extended reach, and lithology may be used to further differentiate the historical data and provide a modeling basis used for interpretation of data trends. Examples of some potential events while drilling are given in the Examples below.

During the drilling of a borehole or wellbore into a subterranean formation, a drilling fluid, also referred to as a drilling mud, may be continuously circulated from the surface down to the bottom of the wellbore being drilled and back to the surface again. The drilling fluid serves several functions, one of them being to transport wellbore cuttings (drilling rock cuttings) up to the surface where they are separated from the drilling fluid. Another function of the drilling fluid is to provide hydrostatic pressure on the walls of the drilled wellbore to prevent wellbore collapse and the resulting influx of gas or liquid from the formations being drilled.

Drilling fluids often include a plurality of particles that impart properties such as viscosity, density, and capabilities such as wellbore strengthening to the drilling fluid. Drilling fluid density is controlled such that the drilling fluid provides enough hydrostatic pressure to prevent invasion of formation fluids into the wellbore while not exceeding the fracture gradient of the formation thereby preventing fracturing of the formation. Weighting agents and viscosifiers can be used to produce drilling fluids with a desired viscosity, which affects the pumpability and equivalent circulating density (ECD) of the drilling fluid. The equivalent circulating density is the dynamic density exerted by the drilling fluid on the formation. As the drilling fluid is pumped through a drill string and out a drill bit, contact is made between the drilling fluid and the wellbore walls as drilling fluid flows upwards to the surface—the Earth surface (not in the Earth crust) at the wellbore but outside of the wellbore. This contact creates drag as a result of friction between the flowing drilling fluid and the wellbore walls and the drilling fluid loses some of the pressure supplied by the pump in order to overcome this frictional drag due. This pressure loss is absorbed by the wellbore walls so the equivalent circulating density is the sum of the pressure loss which may be converted to density and the original mud density of the drilling mud under static conditions.

During drilling operations, the ECD is often carefully monitored and controlled relative to the fracture gradient of the subterranean formation. Typically, the ECD during drilling is close to the fracture gradient without exceeding it. When the ECD exceeds the fracture gradient, a fracture may form in the subterranean formation and drilling fluid may be lost into the subterranean formation, often referred to as lost circulation, or formation fluids may rush into the wellbore causing a kick. The drilling fluid in the wellbore exerts hydrostatic pressure on the wellbore walls, where the magnitude of the hydrostatic pressure is function of the drilling fluid density and vertical depth. The additional pressure felt by the formation or dynamic density referred to as ECD is a function of the viscosity, density, cuttings content, temperature, pressure, and flow rate of the drilling fluid, Modelling ECD can be an involved science but can be generally routine for the present information system, such as having a Baralogix® system (including DFG, etc.) and other software and hardware.

During drilling of a wellbore, the drill bit cuts into the formation causing the formation to break up and form pieces referred to as drill cuttings. These drill cuttings affect the viscosity of the drilling fluid, and therefore the ECD. The drill cuttings may be normally removed by size exclusion techniques such as filtering and gravity exclusion such as by cyclone. However, as the wellbore is drilled, the drill cuttings may be crushed to fine particles that do not readily separate by size exclusion or gravity methods. These difficult to remove solids may be referred to as low gravity solids and may affect the viscosity. Additives that modulate viscosity and other fluid parameters may be added to the drilling fluid to ensure that the ECD does not exceed safe limits for the formation.

Figure 3:
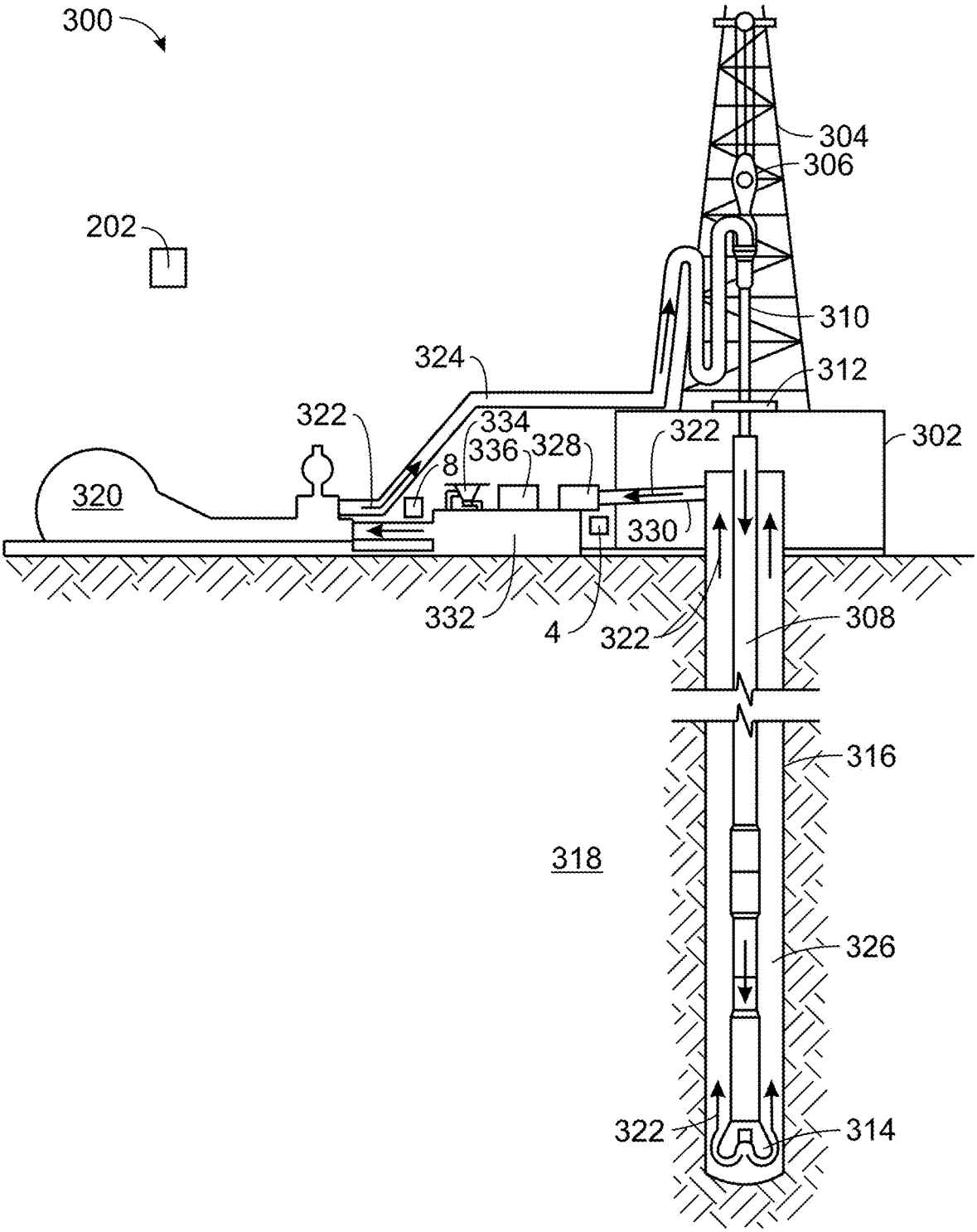
FIG. 3 is a diagram of a drilling assembly.

FIG. 3 is a drilling assembly 300 that includes the single point viscometer 4, the second viscometer 8 (not a single point viscometer), and the information system 202, as discussed with respect to FIG. 2. The drilling assembly 300 may include a drilling platform 302 that supports a derrick 304 having a traveling block 306 for raising and lowering a drill string 308. The drill string 308 may include, but is not limited to, drill pipe and coiled tubing, as generally known to those skilled in the art. A kelly 310 supports the drill string 308 as it is lowered through a rotary table 312. A drill bit 314 is attached to the distal end of the drill string 308 and is driven either by a downhole motor and/or via rotation of the drill string 308 from the well surface. As the drill bit 314 rotates, it creates a wellbore 316 that penetrates various subterranean formations 318.

A pump 320 (e.g., a mud pump) circulates drilling fluid 322 through a feed pipe 324 and to the kelly 310, which conveys the drilling fluid 322 downhole through the interior of the drill string 308 and through one or more orifices in the drill bit 314. The drilling fluid 322 is then circulated back to the surface via an annulus 326 defined between the drill string 308 and the walls of the wellbore 316. At the surface, the recirculated or spent drilling fluid 322 exits the annulus 326 and may be conveyed to one or more fluid processing unit(s) 328 (e.g., a separator(s) such as a shaker) via an interconnecting flow line 330. The one or more fluid processing unit(s) 328 may be useful in removing large drill cuttings (rock cuttings). After passing through the fluid processing unit(s) 328, a "cleaned" drilling fluid 322 is deposited into a nearby retention pit 332 (i.e., a mud pit). While illustrated as being arranged at the outlet of the wellbore 316 via the annulus 326, those skilled in the art will readily appreciate that the fluid processing unit(s) 328 may be arranged at any other location in the drilling assembly 300 to facilitate its proper function, without departing from the scope of the disclosure.

One or more additives (e.g., weighting agents) may be added to the drilling fluid 322 via a mixing hopper 334 communicably coupled to or otherwise in fluid communication with the retention pit 332. The mixing hopper 334 may include, but is not limited to, mixers and related mixing equipment known to those skilled in the art. In other embodiments, however, additives may be added to the drilling fluid 322 at any other location in the drilling assembly 300. In at least one embodiment, for example, there could be more than one retention pit 332, such as multiple retention pits 332 in series. Moreover, the retention pit 332 may be representative of one or more fluid storage facilities and/or units where additives may be stored, reconditioned, and/or regulated until added to the drilling fluid 322. Based on the viscosity measurements, one or more additives may be added to the drilling fluid via the mixing hopper 334 to adjust the viscosity of the drilling fluid to a desired value.

While not specifically illustrated herein, the drilling assembly 300 may also include additional components, for example, shakers (e.g., shale shaker), centrifuges, hydrocyclones, separators (e.g., magnetic and electrical separators), desilters, desanders, filters (e.g., diatomaceous earth filters), heat exchangers, fluid reclamation equipment, sensors, gauges, pumps, compressors, conduits, pipelines, trucks, tubulars, pipes, pumps, compressors, motors, valves, floats, drill collars, mud motors, downhole motors, downhole pumps, MWD/LWD tools, tool seals, packers, roller cone bits, PDC bits, natural diamond bits, any hole openers, reamers, coring bits, and the like, and any communication components associated therewith (e.g., wirelines, telemetry components, etc.).

An embodiment is a method of detecting a drilling event. The method includes flowing a drilling fluid from a wellbore being drilled through a separator, removing rock cuttings from the drilling fluid by the separator (e.g., shaker, shale shaker, etc.), and discharging the drilling fluid from the separator without the rock cuttings removed to a mud pit. The method includes measuring a first viscosity of the drilling fluid upstream of the mud pit with a single point viscometer (e.g., an inline single-point viscometer). Such may involve, for example, measuring the first viscosity of the drilling fluid between the mud pit and an exit of the wellbore with the single point viscometer. In implementations, a measurement interface of the inline single-point viscometer with the drilling fluid to measure the first viscosity is on an exterior of a sensing element of the inline single-point viscometer. The method includes measuring a second viscosity of the drilling fluid in the mud pit or downstream of the mud pit with a second viscometer (e.g., DRU, Fann 35 viscometer, direct-indicating viscometer, etc.) that is not a single point viscometer.

The method includes detecting a drilling event associated with drilling of the wellbore by comparing the first viscosity with the second viscosity. The drilling event may be, for example, influx, drill solids build up, over treatment of the drilling fluid, under treatment of drilling fluid, bit wear, caving, stuck pipe, a hole cleaning issue, or a pack-off issue, or any combinations thereof. Other drilling events may be detected. The method may include measuring a first density of the drilling fluid upstream of the mud pit with the single point viscometer, wherein the single point viscometer includes a density meter; and measuring a second density of the drilling fluid in the mud pit or downstream of the mud pit with the second viscometer, wherein the second viscometer includes a density meter, and wherein detecting the drilling event includes comparing the first density with the second density. The detecting of the drilling event may involve considering operation during the drilling in addition to the first viscosity and the second viscosity (and in addition to the first density and the second density). The considering of the operation may involve evaluating or analyzing the operation, and wherein the operation considered includes operational conditions or operational data, or both. The operation during the drilling may include, for example, ROP, SPP, flow rate of the drilling fluid, torque of a drill bit, drag, level of the mud pit, PWD, ECD, or cuttings transport efficiency, or any combinations thereof.

Another embodiment is a method of detecting a drilling event. The method includes flowing a drilling fluid from a wellbore being drilled through a separator (e.g., a shaker), removing rock cuttings from the drilling fluid by the separator, discharging the drilling fluid from the separator without the rock cuttings removed to a mud pit, measuring a viscosity of the drilling fluid upstream of the mud pit with a single point viscometer (e.g., an inline viscometer), and measuring with a second viscometer a viscosity of the drilling fluid in the mud pit or the drilling fluid downstream of the mud pit between the mud pit and the wellbore, wherein the second viscometer is not a single point viscometer. The method may include pumping the drilling fluid via a pump from the mud pit to the wellbore. In implementation, the measuring of the viscosity with the second viscometer includes measuring the viscosity of the drilling fluid downstream of the mud pit, which includes measuring the viscosity of the drilling fluid downstream of the pump between the pump and the wellbore.

The method includes detecting a drilling event associated with drilling of the wellbore by analyzing (e.g., including performing machine learning) the viscosity measured by the single point viscometer, the viscosity measured by the second viscometer, and additional operational data of the drilling. The additional operational data can include, for example, ROP, SPP, flow rate of the drilling fluid, torque of a drill bit, drag, level of the mud pit, PWD, ECD, or cuttings transport efficiency, or any combinations thereof. The method may include measuring a density of the drilling fluid upstream of the mud pit with the single point viscometer, wherein the single point viscometer includes a density meter; and measuring a density of the drilling fluid in the mud pit or downstream of the mud pit between the mud pit and the wellbore with the second viscometer, wherein the second viscometer includes a density meter. The additional operational data can include the density measured by the single point viscometer and the density measured by the second viscometer.

Yet another embodiment is a method of detecting a drilling event, the method including flowing a drilling fluid from a wellbore being drilled through a shale shaker, removing rock cuttings from the drilling fluid by the shale shaker, discharging the drilling fluid from the shale shaker without the rock cuttings removed to a mud pit, pumping the drilling fluid via a pump from the mud pit to the wellbore, and measuring a first viscosity and a first density of the drilling fluid upstream of the mud pit between the wellbore and the mud pit with a single-point viscosity and density measuring device. In implementations, the single-point viscosity and density measuring device is an inline device and has a measurement interface to measure the first viscosity of the drilling fluid, wherein the measurement interface is on an exterior of a sensing element of the single-point viscosity and density measuring device. The method includes measuring a second viscosity and a second density of the drilling fluid in the mud pit or downstream of the mud pit between the mud pit and the wellbore with a second viscosity and density measuring device. The second viscosity and density measuring device is not a single-point viscosity and density measuring device. The method includes detecting a drilling event associated with drilling of the wellbore by analyzing the first viscosity, the second viscosity, the first density, the second density, and additional operational data of the drilling. The analyzing may include machine learning.

In view of the foregoing, the present disclosure may provide for detecting a drilling event in the drilling of a wellbore. The methods, systems, and tools may include any of the various features disclosed herein, including one or more of the following statements.

Statement 1. A method of detecting a drilling event, the method comprising: flowing a drilling fluid from a wellbore being drilled through a separator; removing rock cuttings from the drilling fluid by the separator; discharging the drilling fluid from the separator without the rock cuttings removed to a mud pit; measuring a first viscosity of the drilling fluid upstream of the mud pit with a single point viscometer; measuring a second viscosity of the drilling fluid in the mud pit or downstream of the mud pit with a second viscometer that is not a single point viscometer; and detecting a drilling event associated with drilling of the wellbore by comparing the first viscosity with the second viscosity.

Statement 2. The method of Statement 1, wherein the separator comprises a shale shaker, and wherein measuring the first viscosity upstream of the mud pit comprises measuring the first viscosity of the drilling fluid between the mud pit and an exit of the wellbore with the single point viscometer.

Statement 3. The method of Statement 1 or 2, wherein the drilling event comprises influx, drill solids build up, over treatment of the drilling fluid, under treatment of drilling fluid, bit wear, caving, stuck pipe, a hole cleaning issue, or a pack-off issue, or any combinations thereof.

Statement 4. The method of any preceding Statement, comprising: measuring a first density of the drilling fluid upstream of the mud pit with the single point viscometer, wherein the single point viscometer comprises a density meter; and measuring a second density of the drilling fluid in the mud pit or downstream of the mud pit with the second viscometer, wherein the second viscometer comprises a density meter, and wherein detecting the drilling event comprises comparing the first density with the second density.

Statement 5. The method of any preceding Statement, wherein detecting the drilling event comprises considering operation during the drilling in addition to the first viscosity and the second viscosity.

Statement 6. The method of Statement 5, wherein the operation during drilling considered comprises rate of penetration (ROP), stand pipe pressure (SPP), flow rate of the drilling fluid, torque of a drill bit, drag, level of the mud pit, pressure while drilling (PWD), equivalent circulating density (ECD), or cuttings transport efficiency, or any combinations thereof.

Statement 7. The method of any preceding Statement, wherein the single point viscometer is an inline single-point viscometer.

Statement 8. The method of Statement 7, wherein a measurement interface of the inline single-point viscometer with the drilling fluid to measure the first viscosity is on an exterior of a sensing element of the inline single-point viscometer.

Statement 9. A method of detecting a drilling event, the method comprising: flowing a drilling fluid from a wellbore being drilled through a separator; removing rock cuttings from the drilling fluid by the separator; discharging the drilling fluid from the separator without the rock cuttings removed to a mud pit; measuring a viscosity of the drilling fluid upstream of the mud pit with a single point viscometer; measuring with a second viscometer a viscosity of the drilling fluid in the mud pit or the drilling fluid downstream of the mud pit between the mud pit and the wellbore, wherein the second viscometer is not a single point viscometer; and detecting a drilling event associated with drilling of the wellbore by analyzing the viscosity measured by the single point viscometer, the viscosity measured by the second viscometer, and additional operational data of the drilling.

Statement 10. The method of Statement 9, wherein the analyzing comprises performing machine learning.

Statement 11. The method of Statement 9 or 10, comprising: measuring a density of the drilling fluid upstream of the mud pit with the single point viscometer, wherein the single point viscometer comprises a density meter; and measuring a density of the drilling fluid in the mud pit or downstream of the mud pit between the mud pit and the wellbore with the second viscometer, wherein the second viscometer comprises a density meter.

Statement 12. The method of Statement 11, wherein the additional operational data comprises the density measured by the single point viscometer and the density measured by the second viscometer.

Statement 13. The method of Statement 9 to 12, wherein the additional operational data comprises rate of penetration (ROP), stand pipe pressure (SPP), flow rate of the drilling fluid, torque of a drill bit, drag, level of the mud pit, pressure while drilling (PWD), equivalent circulating density (ECD), or cuttings transport efficiency, or any combinations thereof.

Statement 14. The method of Statement 9 to 13, wherein the single point viscometer comprises an inline viscometer.

Statement 15. The method of Statement 9 to 14, wherein the separator comprises a shaker, and wherein a measurement interface of the single point viscometer with the drilling fluid to measure the viscosity of the drilling fluid with the single point viscometer is on an exterior of a sensing element of the single point viscometer.

Statement 16. The method of Statement 9 to 15, comprising pumping the drilling fluid via a pump from the mud pit to the wellbore, wherein measuring the viscosity with the second viscometer comprises measuring the viscosity of the drilling fluid downstream of the pump between the pump and the wellbore.

Statement 17. A method of detecting a drilling event, the method comprising: flowing a drilling fluid from a wellbore being drilled through a shale shaker; removing rock cuttings from the drilling fluid by the shale shaker; discharging the drilling fluid from the shale shaker without the rock cuttings removed to a mud pit; pumping the drilling fluid via a pump from the mud pit to the wellbore; measuring a first viscosity and a first density of the drilling fluid upstream of the mud pit between the wellbore and the mud pit with a single-point viscosity and density measuring device; measuring a second viscosity and a second density of the drilling fluid in the mud pit or downstream of the mud pit between the mud pit and the wellbore with a second viscosity and density measuring device, wherein the second viscosity and density measuring device is not a single-point viscosity and density measuring device; and detecting a drilling event associated with drilling of the wellbore by analyzing the first viscosity, the second viscosity, the first density, the second density, and additional operational data of the drilling.

Statement 18. The method of Statement 17, wherein the additional operational data comprises rate of penetration (ROP), stand pipe pressure (SPP), flow rate of the drilling fluid, torque of a drill bit, drag, level of the mud pit, pressure while drilling (PWD), equivalent circulating density (ECD), or cuttings transport efficiency, or any combinations thereof.

Statement 19. The method of Statement 17 or 18, wherein the single-point viscosity and density measuring device is an inline device and comprises a measurement interface to measure the first viscosity of the drilling fluid, wherein the measurement interface is on an exterior of a sensing element of the single-point viscosity and density measuring device.

Statement 20. The method of Statement 17 to 19, wherein the analyzing comprises machine learning.

The present embodiments are well adapted to attain the ends and advantages mentioned as well as those that are inherent therein. The particular embodiments disclosed are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

EXAMPLES

These Examples given as examples and thus not meant to limit the present techniques. Tables 1, 2, 3, and 4 each provide evaluation of measures for detection of a respective drilling event. For each measure, an indication is noted. Further, a potential indication order is given. The indication order is the order at which (of when) the indication appears or becomes apparent. An indication order ranking of 1 means first appears. Indication order rankings of 2, 3, and 4 mean thereafter in that order. The term "delayed" utilized in the tables below means generally delayed by at least one hour. The term "gradual" means, for instance, less than 5% change per hour. The term "small" generally means less than 10%. The term "very small" generally means less than 5%. The term "potential" may mean anticipating or some possible indication.

In these Examples, the term "Rheonics" (e.g., FIG. 1) refers to a single point viscometer (e.g., reference numeral 4 of FIG. 2) as discussed above and as situated in FIG. 2. The term "DRU" refers to a second viscometer (e.g., reference numeral 8 of FIG. 2) as utilized in FIG. 2 and that can be the Baralogix® DRU.

As listed in the tables below, the phrase "Rheonics versus DRU delta viscosity" means the difference (delta) in the viscosity value (of drilling fluid returning from the wellbore) measured by the Rheonics device compared to the viscosity value (of drilling fluid being supplied to the wellbore) measured by the DRU. Likewise, the phrase "Rheonics versus DRU delta density" means the difference in the density value measured by the Rheonics device compared to the density value measured by the DRU. In general, drilling operational trending (e.g., with solids build up, etc.) can change density and viscosity of the drilling fluid downhole in the wellbore. Thus, the drilling-fluid property data collected via the Rheonics device and the DRU can be examined to form both a real-time sense and a trending with time sense. For example, a 10 percent viscosity increase over a few hours of drilling could be deemed excessive based on historical data.

As listed in the tables below, the phrase "flow rate (out vs in)" means the flow rate of the drilling fluid (return) out of the wellbore versus the flow rate of the drilling fluid (supply) into the wellbore. In some cases, for example, with lost circulation, gas influx, oil influx, or water influx, the flow rate of the drilling fluid entering the wellbore is measurably different than the flow rate of the drilling exiting the wellbore. Further, the "Pit Level" in the tables below refers to the liquid level in the mud pit. In some instances, a measurable pit level change may not be the result of an adverse drilling event. In other instances, a drilling event (e.g., excess water influx, gas influx, etc.) can cause a measurable pit level change.

Table 1 gives evaluation considerations for detecting a drilling event that is influx (into the wellbore) while drilling.

TABLE 1

Influx Event while Drilling

| Measure | Indication | Potential Indication Order |
|---|---|---|
| ROP (rate of penetration) | No change | |
| SPP (stand pipe pressure) | Lowering trend | 1 |
| Flow rate (out vs in) | Constant | 1 >= pump rate |
| Torque | Lower/potential lowering | 4 |
| Drag | Not applicable (NA) | |
| DRU Rheology | Delayed lowering trend | 3 |
| DRU Density | Delayed lowering trend | 3 |
| Rheonics viscosity | Lowering trend | 2 |
| Rheonics density | Lowering trend | 2 |
| Rheonics versus DRU delta viscosity | Lowering trend | 1 |
| Rheonics versus DRU delta density | Lowering trend | 1 |
| Pit level | Increase/potential increase | 3 |
| PWD vs modeled ECD | Lowering trend | 1 |
| Cuttings x-port Efficiency | Lowering trend | 2-3 |

Table 2 gives evaluation considerations for detecting a drilling event that is drill solids build up in the wellbore while drilling.

TABLE 2

Drill Solids Buildup Event while Drilling

| Measure | Indication | Potential Indication order |
|---|---|---|
| ROP (rate of penetration) | No change | |
| SPP (standard pipe pressure) | increasing trend | 1 |
| Flow rate (out vs in) | No change | |
| Torque | Potential increasing | 4 |
| Drag | small increasing trend | |
| DRU Rheology | Gradual increasing trend | 3 |
| DRU Density | Gradual increasing trend | 3 |
| Rheonics viscosity | Gradual increasing trend | 2 |
| Rheonics density | Gradual increasing trend | 2 |
| Rheonics vs DRU delta viscosity | Very small increase | 1 |
| Rheonics vs DRU delta density | Very small increase | 1 |
| Pit level | Small potential increase | 3 |
| PWD (pressure while drilling) | Small Increasing | 1 |
| Cuttings x-port Efficiency | Small increasing eff | 3 |

Table 3 gives evaluation considerations for detecting a drilling event that is hole cleaning issues of the wellbore while drilling.

TABLE 3

| Hole Cleaning Issues | | |
|---|---|---|
| Measure | Indication | Potential Indication order |
| ROP | No change | 3 |
| SPP | Upward trend | 1 |
| Flow rate (out vs in) | Constant | 1 >= pump rate |
| Torque | Increased standard deviation (STD) or amplitude of reading | 2 |
| Drag | NA | |
| DRU Rheology | Delayed lowering trend | 1 |
| DRU Density | Delayed lowering trend | 3 |
| Rheonics viscosity | Lowering trend | 2 |
| Rheonics density | Lowering trend | 3 |
| Rheonics vs DRU delta viscosity | Lowering trend | 1 |
| Rheonics vs DRU delta density | Lowering trend | 2 |
| Pit level | Potential increase | 4 |
| PWD versus modeled ECD | Lowering trend | 1 |
| Cuttings x-port Efficiency | Lowering trend | 2 |

Table 4 gives evaluation considerations for detecting a drilling event that is pack-off issues while drilling.

TABLE 4

| Pack-Off Issues | | |
|---|---|---|
| Measure | Indication | Potential Indication order |
| ROP | No change | 3 |
| SPP | Spike/Rapid increase | 1 |
| PWD (pressure while drilling) | Spike/Increase Trend | 1 |
| Flow rate (out vs in) | Constant | 1 >= pump rate |
| Torque | High Amplitude, STD | 2 |
| Drag | NA | |
| DRU Rheology | Delayed lowering trend | 1 |
| DRU Density | Delayed lowering trend | 2 |
| Rheonics viscosity | Lowering trend | 2 |
| Rheonics density | Lowering trend | 3 |
| Rheonics vs DRU delta viscosity | Lowering trend | 1 |
| Rheonics vs DRU delta density | Lowering trend | 2 |
| Pit level | Potential increase | 4 |
| PWD vs modeled ECD | Lowering trend | 1 ECD = effective density |
| Cuttings x-port Efficiency | Lowering trend | 2 |

What is claimed is:

1. A method of detecting a drilling event, the method comprising:

flowing a drilling fluid from a wellbore being drilled through a separator;

removing rock cuttings from the drilling fluid by the separator;

discharging the drilling fluid from the separator without the removed rock cuttings to a mud pit;

measuring a first viscosity of the drilling fluid upstream of the mud pit with a single point viscometer;

measuring a second viscosity of the drilling fluid in the mud pit or downstream of the mud pit with a second viscometer that is not a single point viscometer;

calibrating the single point viscometer based on the second viscosity measured by the second viscometer; and detecting a drilling event associated with drilling of the wellbore by comparing the first viscosity with the second viscosity.

2. The method of claim 1, wherein the separator comprises a shale shaker, and wherein measuring the first viscosity upstream of the mud pit comprises measuring the first viscosity of the drilling fluid between the mud pit and an exit of the wellbore with the single point viscometer.

3. The method of claim 1, wherein the drilling event comprises influx, drill solids build up, over treatment of the drilling fluid, under treatment of drilling fluid, bit wear, caving, stuck pipe, a hole cleaning issue, or a pack-off issue, or any combinations thereof.

4. The method of claim 1, comprising:

measuring a first density of the drilling fluid upstream of the mud pit with the single point viscometer, wherein the single point viscometer comprises a density meter; and measuring a second density of the drilling fluid in the mud pit or downstream of the mud pit with the second viscometer, wherein the second viscometer comprises a density meter, and wherein detecting the drilling event comprises comparing the first density with the second density.

5. The method of claim 1, wherein detecting the drilling event comprises considering operation during the drilling in addition to the first viscosity and the second viscosity, wherein the operation during the drilling considered comprises rate of penetration (ROP), stand pipe pressure (SPP), flow rate of the drilling fluid, torque of a drill bit, drag, level of the mud pit, pressure while drilling (PWD), equivalent circulating density (ECD), or cuttings transport efficiency, or any combinations thereof.

6. The method of claim 1, wherein the drilling fluid from the wellbore being drilled comprises the drilling fluid returned from the wellbore, wherein the measuring of the first viscosity comprises measuring the first viscosity of the drilling fluid returned from the wellbore upstream of the mud pit between the mud pit and an exit of the wellbore with the single point viscometer, wherein the discharging the drilling fluid from the separator without the removed rock cuttings to the mud pit is for supply of the drilling fluid to the wellbore, and wherein the measuring of the second viscosity comprises measuring the second viscosity of the drilling fluid supplied to the wellbore in the mud pit or downstream of the mud pit between the mud pit and the wellbore with the second viscometer.

7. The method of claim 1, wherein the single point viscometer is an inline single-point viscometer.

8. The method of claim 7, wherein a measurement interface of the inline single-point viscometer with the drilling fluid to measure the first viscosity is on an exterior of a sensing element of the inline single-point viscometer.

9. A method of detecting a drilling event, the method comprising:

flowing a drilling fluid from a wellbore being drilled through a separator;

removing rock cuttings from the drilling fluid by the separator;

discharging the drilling fluid from the separator without the removed rock cuttings to a mud pit;

measuring a viscosity of the drilling fluid upstream of the mud pit with a single point viscometer;

measuring with a second viscometer a viscosity of the drilling fluid in the mud pit or the drilling fluid downstream of the mud pit between the mud pit and the wellbore, wherein the second viscometer is not a single point viscometer;

calibrating the single point viscometer based on the viscosity measured by the second viscometer; and detecting a drilling event associated with drilling of the wellbore by analyzing the viscosity measured by the single point viscometer, the viscosity measured by the second viscometer, and additional operational data of the drilling.

10. The method of claim 9, wherein the analyzing comprises performing machine learning.

11. The method of claim 9, comprising:

measuring a density of the drilling fluid upstream of the mud pit with the single point viscometer, wherein the single point viscometer comprises a density meter; and measuring a density of the drilling fluid in the mud pit or downstream of the mud pit between the mud pit and the wellbore with the second viscometer, wherein the second viscometer comprises a density meter.

12. The method of claim 11, wherein the additional operational data comprises the density measured by the single point viscometer and the density measured by the second viscometer.

13. The method of claim 9, wherein the additional operational data comprises rate of penetration (ROP), stand pipe pressure (SPP), flow rate of the drilling fluid, torque of a drill bit, drag, level of the mud pit, pressure while drilling (PWD), equivalent circulating density (ECD), or cuttings transport efficiency, or any combinations thereof.

14. The method of claim 9, wherein the single point viscometer comprises an inline viscometer.

15. The method of claim 14, wherein the separator comprises a shaker, and wherein a measurement interface of the single point viscometer with the drilling fluid to measure the viscosity of the drilling fluid with the single point viscometer is on an exterior of a sensing element of the single point viscometer.

16. The method of claim 9, comprising pumping the drilling fluid via a pump from the mud pit to the wellbore, wherein measuring the viscosity with the second viscometer comprises measuring the viscosity of the drilling fluid downstream of the pump between the pump and the wellbore.

17. A method of detecting a drilling event, the method comprising:

flowing a drilling fluid from a wellbore being drilled through a shale shaker;

removing rock cuttings from the drilling fluid by the shale shaker;

discharging the drilling fluid from the shale shaker without the removed rock cuttings to a mud pit;

pumping the drilling fluid via a pump from the mud pit to the wellbore;

measuring a first viscosity and a first density of the drilling fluid upstream of the mud pit between the wellbore and the mud pit with a single-point viscometer;

measuring a second viscosity and a second density of the drilling fluid in the mud pit or downstream of the mud pit between the mud pit and the wellbore with a second viscometer that is not a single-point viscometer;

calibrating the single point viscometer based on the second viscosity measured by the second viscometer; and detecting a drilling event associated with drilling of the wellbore by analyzing the first viscosity, the second viscosity, the first density, the second density, and additional operational data of the drilling.

18. The method of claim 17, wherein the additional operational data comprises rate of penetration (ROP), stand pipe pressure (SPP), flow rate of the drilling fluid, torque of a drill bit, drag, level of the mud pit, pressure while drilling (PWD), equivalent circulating density (ECD), or cuttings transport efficiency, or any combinations thereof.

19. The method of claim 17, wherein the single-point viscometer is an inline device and comprises a measurement interface to measure the first viscosity of the drilling fluid, wherein the measurement interface is on an exterior of a sensing element of the single-point viscometer.

20. The method of claim 17, wherein the analyzing comprises machine learning.

* * * * *